US010369828B2

(12) United States Patent
Mcmanus

(10) Patent No.: US 10,369,828 B2
(45) Date of Patent: Aug. 6, 2019

(54) GLOSSY MEDIA SHEET

(75) Inventor: Richard J. Mcmanus, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 2261 days.

(21) Appl. No.: 11/398,786

(22) Filed: Apr. 6, 2006

(65) Prior Publication Data

US 2007/0237909 A1 Oct. 11, 2007

(51) Int. Cl.

*B41M 5/50* (2006.01)
*B41M 5/52* (2006.01)
*G03G 7/00* (2006.01)

(52) U.S. Cl.

CPC ..... *B41M 5/5218* (2013.01); *G03G 7/0013* (2013.01)

(58) Field of Classification Search

CPC ..... B41M 5/5218; G03G 7/0013
See application file for complete search history.

(56) References Cited

U.S. PATENT DOCUMENTS 4,971,950 A * 11/1990 Kato et al. ..... 503/227
5,116,418 A 5/1992 Kaliski
5,207,822 A 5/1993 Manasso et al.
5,279,663 A 1/1994 Kaliski
5,985,424 A * 11/1999 DeMatte et al. ..... 428/212
5,997,625 A 12/1999 Londo et al.
6,156,117 A 12/2000 Freeman et al.
6,402,827 B1 6/2002 Freeman et al.
6,465,086 B1 * 10/2002 Kitamura et al. ..... 428/32.25
2003/0134093 A1 * 7/2003 Kitamura ..... B41M 5/5227 428/195.1
2004/0076772 A1 4/2004 Schliesman
2005/0282026 A1 12/2005 Wuu et al.

FOREIGN PATENT DOCUMENTS

EP 1106377 6/2001
EP 1 491 499 A1 12/2004
EP 1 506 877 A1 2/2005
JP 57-135190 8/1982
JP 63-183889 7/1988
JP 1-45895 2/1989
JP 02-164583 6/1990
JP 4-250092 9/1992
JP 06-073700 3/1994
JP 7-195825 8/1995
JP 09-031892 2/1997
JP 09-267573 10/1997
JP 2003-103945 4/2003
JP 2003-105691 4/2003

(Continued)

OTHER PUBLICATIONS

Murray, Traditional and new applications of kaolin, Applied Caly Science, 2000, 17, p. 207-221.*

(Continued)

*Primary Examiner* — Scott R. Walshon
*Assistant Examiner* — Sathavaram I Reddy
(74) *Attorney, Agent, or Firm* — Thorpe North & Western LLP

(57) ABSTRACT

A media sheet has an image-receiving layer that includes about 30 to about 70 percent calcined clay.

16 Claims, 1 Drawing Sheet

(56) References Cited

FOREIGN PATENT DOCUMENTS

| | | |
|---|---|---|
| JP | 2004-299316 | 10/2004 |
| JP | 2005-254758 | 9/2005 |
| JP | 2005-264398 | 9/2005 |
| JP | 2005-288881 | 10/2005 |
| WO | 98/36026 | 8/1998 |

OTHER PUBLICATIONS

Japanese Office Action dated May 22, 2012 corresponding to U.S. Appl. No. 11/398,786, filed Apr. 6, 2006.

Hewlett-Packard Development Company, L.P., Office Action dated Jun. 21, 2011, Jap. Pat. App. No. 2009-504,427, 3 p. This action is not translated. A translated copy will be filed as soon as it is received.

Hewlett-Packard Development Company, L.P., List of References cited in Office Action dated Jun. 21, 2011, Jap. Pat. App. No. 2009-504,427, 1 p.

* cited by examiner

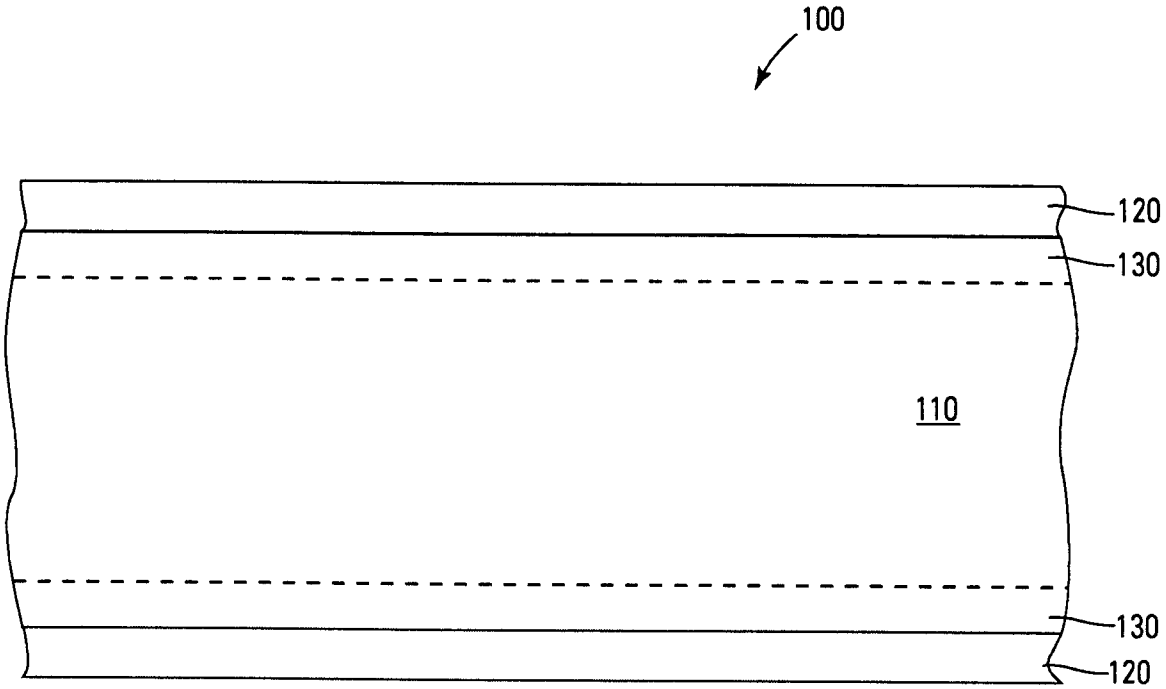
100
120
130
110
130
120

GLOSSY MEDIA SHEET

BACKGROUND

With the demand for customized print matter, such as mailings, catalogs, brochures, and flyers increasing and the desire to optimize printer efficiency in regard to job set up times, particularly on smaller run sizes, digital copiers and presses have become more ubiquitous in the printing industry. Digital printers encompass a range of technologies including electrophotographic and inkjet technologies. To take full advantage of these systems, the media that are printed often need to be optimized for that particular technology. Media for some inkjet technologies should to be highly absorptive. Typical glossy media for the above mentioned applications are not designed for inkjet technology. Instead, they have been designed for offset or gravure type printing presses, whose demand for absorptivity is very low when compared with an inkjet system. Media with low absorptivity will result in inefficient drying of the printed image that can lead to printer contamination, image smearing, and reduced performance.

DESCRIPTION OF THE DRAWINGS

FIG. 1 is a cross-sectional view of a media sheet, according to an embodiment of the invention.

DETAILED DESCRIPTION

In the following detailed description of the present embodiments, reference is made to the accompanying drawings that form a part hereof, and in which are shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

FIG. 1 is a cross-sectional view of a media sheet 100, such as a coated-grade media sheet, e.g., suitable for use in an imaging device, such as a color ink-jet printer, according to an embodiment. Media sheet 100 includes a substrate 110, such as of paper, e.g., fabric paper stock, or the like. An image-receiving layer (or coating) 120 is formed on substrate 110. For one embodiment, image-receiving layer 120 is formed either on opposing (upper and lower) surfaces of substrate 110, as shown, or on one of the surfaces of substrate 110.

For one embodiment, image-receiving layer 120 has a gloss level above about 50 as measured at a 75-degree view angle. For a preferred embodiment, the image-receiving layer 120 has a gloss level of about 65 to about 75 as measured at a 75-degree view angle using a Micro-gloss 75 75-degree gloss meter manufactured by BYK-Gardner GmbH (Geretsried, DE). The gloss of the image-receiving layer can be achieved through, but is not limited to, such processes as calendering, super-calendering, and casting of the imaging layer. For another embodiment, image-receiving layer 120 has a thickness greater than about 1 micron. For example, in one embodiment, image-receiving layer 120 has a thickness of about 2 microns to about 50 microns. Note that image-receiving layer 120 is the outermost layer of media sheet 100. For one embodiment, image-receiving layer 120 receives marking fluid, e.g., liquid ink droplets, ejected from an imaging device during a printing process.

For various embodiments, image-receiving layer 120 includes first and second pigments as described below. An optional third pigment is also described below. For another embodiment, image-receiving layer 120 may also include one or more binders that may include, but are not limited, to polyvinylalcohol, polyvinylacetates, polyacrylates, polymethacrylates, polystyrene-butadiene, polyethylene-polyvinyacetate copolymers, starch, casein, gelatin and mixtures and copolymers thereof. Other additives, such as colorants, optical brighteners, defoamers, wetting agents, rheology modifiers and other additives known in the art may be added for some embodiments.

For one embodiment, image-receiving layer 120 includes at least first and second pigments. For another embodiment, the first pigment acts to provide an absorption characteristic of image-receiving layer 120 so that marking fluid ejected onto image-receiving layer 120 is sufficiently dry after an imaging device has finished disposing images on image-receiving layer 120. For one embodiment, the first pigment is calcined clay, such as ANSILEX 93, manufactured by Englehard Corporation (Iselin, N.J., U.S.A.), or NEOGEN 2000, manufactured by Imerys Pigments, Inc. (Roswell, Ga., U.S.A.). For one embodiment, image-receiving layer 120 is about 25 to about 70 percent, by dry weight, calcined clay. For a preferred embodiment, image-receiving layer 120 is about 35 to about 60 percent, by dry weight, calcined clay. Calcined clay amounts above about 70 percent may result in poor gloss and image mottling, while calcined clay amounts below about 25 percent may result in poor absorption. For another embodiment, the calcined clay has a median esd (equivalent spherical diameter) of less than about 1.6 microns as determined by a Microtrac-UPA150 laser light scattering device. For some embodiments, the calcined clay has an oil absorption of greater than about 100 grams of oil per 100 grams of calcined clay as determined according to American Society of Testing and Materials (ASTM) standard ASTM D 281-95.

The second pigment acts to provide a gloss characteristic of image-receiving layer 120 and to improve the uniformity of the ink absorption thus leading to a reduction in mottle of the printed image that is apparent when using a calcined clay pigment as the sole inorganic pigment in the image layer 120. For one embodiment, the second pigment is an inorganic pigment, such as an ultrafine kaolin clay, such as MIRAGLOS 91, manufactured by Englehard Corporation (Iselin, N.J., U.S.A.), or POLYGLOSS 90, manufactured by J.M. Huber Corporation (Edison, N.J., U.S.A.). Another suitable inorganic pigment may be precipitated calcium carbonate, preferably of aragonitic crystalline structure, such as Opacarb A40, manufactured by Specialty Minerals, Inc. (Bethlehem, Pa., U.S.A.). For some embodiments, the kaolin clay and the calcium carbonate have a median esd of less than about 650 nanometers as determined by a Microtrac-UPA150 laser light scattering device. For example, in one embodiment image-receiving layer 120 is comprised of calcined clay between about 25 and about 70 percent and of a second pigment from about 30 to 60 percent by dry weight of the image-receiving layer 120.

For another embodiment, image-receiving layer 120 may include, first, second, and third pigments. The third pigment may be a plastic pigment made of polystyrene, polymethacrylates, or polyacrylates or copolymers thereof for one embodiment. The plastic pigments may be of the solid or hollow. However, the preferred form is the solid type with a median esd of less than about 500 nanometers. Examples of such particles are 788A, 756A and 722HS from Dow Chemical (Midland, Mich., U.S.A.) For example, in one embodiment, image-receiving layer 120 may include calcined clay, kaolin clay, and a plastic pigment. For another embodiment, image-receiving layer 120 includes about 25 to 70 percent calcined clay for absorption, about 30 to 60 percent ultrafine kaolin clay for gloss and improved imaging, and about 1 to 4 percent plastic pigment for added gloss by dry weight. For another embodiment, image-receiving layer 120 includes about 25 to 70 percent calcined clay for absorption, about 30 to 60 percent precipitated calcium carbonate for gloss and improved imaging, and about 1 to 4 percent plastic pigment for added gloss by dry weight.

For one embodiment, applying an aqueous coating to the upper or upper and lower surfaces of substrate 110 forms image-receiving layer 120. For one embodiment, the aqueous coating is in the form of an aqueous suspension, e.g., that includes about 35 to about 65 percent solids, with the solids including the first and second pigments or the first, second, and third pigments, described above. For other embodiments, an optional pre-coat (or intermediate layer) 130, e.g., comprised of silica, alumina, calcined clay, calcium carbonate, kaolin clay etc., may be formed on the upper or upper and lower surfaces of substrate 110 before forming image-receiving layer 120, with image-receiving layer 120 being formed on intermediate layer 130. For one embodiment, coating the upper or upper and lower surfaces of substrate 110 with an aqueous suspension containing the components of intermediate layer 130 forms intermediate layer 130.

CONCLUSION

Although specific embodiments have been illustrated and described herein it is manifestly intended that the scope of the claimed subject matter be limited only by the following claims and equivalents thereof.

What is claimed is:

1. A media sheet, comprising:

a substrate; and an inkjet image-receiving layer formed on the substrate as an outermost layer of the media sheet, the inkjet image-receiving layer having a thickness from about 2 microns to about 50 microns; wherein the inkjet image-receiving layer comprises about 25 to about 70 percent by dry weight of calcined clay having an oil absorption of greater than about 100 grams of oil per 100 grams of calcined clay, and a median particle size of less than about 1.6 microns;

wherein the inkjet image-receiving layer also comprises about 30 to about 60 percent of kaolin clay or precipitated calcium carbonate, wherein said kaolin clay or said precipitated calcium carbonate have a median particle size of less than about 650 nanometers;

wherein the gloss of the inkjet image-receiving layer is greater than about 50 when measured at a 75 degree viewing angle;

and wherein the media sheet does not include an intermediate layer between the substrate and the image-receiving layer.

2. The media sheet of claim 1, wherein the inkjet image-receiving layer further comprises a plastic pigment having a median particle size of less than about 500 nanometers.

3. The media sheet of claim 2, wherein the plastic pigment is present up to about 5 percent plastic pigment by dry weight.

4. The media sheet of claim 1, wherein said inkjet image-receiving layer comprises about 35 to about 60 percent calcined clay by dry weight.

5. The media sheet of claim 1, wherein the gloss of the inkjet image-receiving layer is from about 65 to about 75 when measured at a 75 degree viewing angle.

6. The media sheet of claim 1, wherein the inkjet image-receiving layer comprises precipitated calcium carbonate.

7. The media sheet of claim 1, wherein the inkjet image-receiving layer further comprises about 1 to about 4 percent plastic pigment by dry weight.

8. A media sheet comprising:

a paper substrate; and an inkjet image-receiving layer formed on the paper substrate as an outermost layer of the media sheet, the inkjet image-receiving layer having a thickness from about 2 microns to about 50 microns;

wherein the inkjet image-receiving layer comprises at least a first pigment for absorption and a second pigment for gloss;

wherein the first pigment is calcined clay that makes up about 25 to about 70 percent of the inkjet image-receiving layer by dry weight and has an oil absorption of greater than about 100 grams of oil per 100 grams of calcined clay, and the calcined clay has a median particle size of less than about 1.6 microns;

wherein the second pigment is an inorganic pigment that makes up about 30 to about 60 percent of the inkjet image-receiving layer by dry weight having a median particle size of less than about 650 nanometers;

wherein the gloss of the inkjet image-receiving layer is from about 65 to about 75 when measured at a 75 degree viewing angle; and wherein the media sheet does not include an intermediate layer between the substrate and the image-receiving layer.

9. A method of forming a media sheet, comprising:

forming an inkjet image-receiving layer overlying at least one surface of a substrate, the inkjet image-receiving layer comprising about 25 to about 70 percent by dry weight of calcined clay having an oil absorption of greater than about 100 grams of oil per 100 grams of calcined clay, said calcined clay has a median particle size of less than about 1.6 microns, the inkjet image-receiving layer has a thickness from about 2 microns to about 50 microns;

wherein the inkjet image-receiving layer also comprises about 30 to about 60 percent of kaolin clay or precipitated calcium carbonate, wherein said kaolin clay and said precipitated calcium carbonate have a median particle size of less than about 650 nanometers; and wherein the gloss of the inkjet image-receiving layer is greater than about 50 when measured at a 75 degree viewing angle, and wherein the media sheet does not include an intermediate layer between the substrate and the inkjet image-receiving layer.

10. The method of claim 9, wherein forming the inkjet image-receiving layer overlying the at least one surface of the substrate comprises: coating the at least one surface with an aqueous coating containing said calcined clay, and at least one of said kaolin clay and said precipitated calcium carbonate.

11. The method of claim 10, wherein the aqueous coating comprises kaolin clay, or precipitated calcium carbonate, or both the kaolin clay and the precipitated calcium carbonate, wherein said kaolin clay and percent precipitated calcium carbonate has a median particle size of less than about 650 nanometers.

12. The method of claim 9 further comprising pre-coating the substrate before forming the inkjet image-receiving layer.

13. The method of claim 9, wherein the gloss of the inkjet image-receiving layer is from about 65 to about 75 when measured at a 75 degree viewing angle.

14. A method of printing, comprising:

disposing a marking material on an inkjet image-receiving layer of the media sheet of claim 1.

15. The method of claim 14, wherein the disposing of the marking material on the inkjet image-receiving layer comprises ejecting liquid droplets of the marking material onto the inkjet image-receiving layer.

16. The method of claim 14, wherein the inkjet image-receiving layer further comprises at least kaolin clay, precipitated calcium carbonate, or both.

* * * * *